US011290797B2

(12) United States Patent
Aviv et al.

(10) Patent No.: US 11,290,797 B2
(45) **Date of Patent: *Mar. 29, 2022**

(54) INTELLIGENT CABLE ADAPTER DIGITAL SIGNAL PROCESSING SYSTEM AND METHOD

(71) Applicant: Prophet Productions, LLC, New York, NY (US)

(72) Inventors: Bobby Elijah Aviv, New York, NY (US); David G. Aviv, Las Vegas, NV (US); Mark Schaffel, Thompsons Station, TN (US); Guy Zohar, Nahsholim (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/354,893

(22) Filed: Jun. 22, 2021

(65) Prior Publication Data

US 2021/0321186 A1 Oct. 14, 2021

Related U.S. Application Data

(63) Continuation of application No. 17/152,702, filed on Jan. 19, 2021, now Pat. No. 11,076,213, and a (Continued)

(51) Int. Cl.

| | |
|---|---|
| ***H04R 1/04*** | (2006.01) |
| ***H04R 1/22*** | (2006.01) |
| ***H04R 5/04*** | (2006.01) |

(52) U.S. Cl.

CPC ..... *H04R 1/04* (2013.01); *H04R 1/22* (2013.01); *H04R 5/04* (2013.01)

(58) Field of Classification Search

None

See application file for complete search history.

(56) References Cited

U.S. PATENT DOCUMENTS

| | | | |
|---|---|---|---|
| 5,105,711 | A | 4/1992 | Barnard |
| 5,245,128 | A | 9/1993 | Araiza |

(Continued)

OTHER PUBLICATIONS

International Search Report and Written Opinion for International Patent Application No. PCT/US2019/044257, dated Oct. 17, 2019.

(Continued)

*Primary Examiner* — Paul W Huber

(74) *Attorney, Agent, or Firm* — Amy L. Pearson

(57) ABSTRACT

A specialized audio/instrument cable adapter with built-in digital signal processing capabilities that adds user-defined audio effects (such as reverb, delay, chorus and/or distortion) from within the cable adapter itself to affect the sound generated from an instrument or microphone such that the cable adapter (with a instrument/microphone cable) is the only connection needed between the instrument or microphone and an output device (such as an amplifier, PA, powered speaker, music mixer, or a recording device). The audio effects used by the cable adapter can be changed via (i) an app from a smartphone, tablet, computer or other electronic device; (ii) a wireless controller that attaches to the instrument; (iii) a pedal, and/or (iv) any other type of wireless controller that has the ability to communicate with a smartphone/tablet/computer or other electronic device.

27 Claims, 9 Drawing Sheets

Related U.S. Application Data continuation-in-part of application No. PCT/US2019/044257, filed on Jul. 31, 2019.

(56) References Cited

U.S. PATENT DOCUMENTS

| | | | | |
|---|---|---|---|---|
| 7,541,536 | B2 | 6/2009 | Shavit | |
| 8,063,294 | B1 | 11/2011 | Amberg | |
| 8,816,182 | B2 | 8/2014 | Robertson | |
| 8,865,992 | B2 | 10/2014 | Shavit | |
| 9,548,044 | B2 | 1/2017 | Chekardzhikov | |
| 9,812,106 | B1 | 11/2017 | Miller | |
| 2007/0003073 | A1 | 1/2007 | Iriarte | |
| 2007/0131100 | A1 | 6/2007 | Daniel | |
| 2015/0139440 | A1 | 5/2015 | Crawford | |
| 2015/0176890 | A1* | 6/2015 | Spanos | H01B 13/0167 62/62 |

OTHER PUBLICATIONS

Thorn, Pete, Revpad Incredible sounding guitar FX w/Touchpad demo by Pete Thorn, Feb. 3, 2018, https://www.youtube.com/watch?v=TLPnZwdYF10.

Gil, GTC Sound Innovations Revpad wireless guitar multi-fx demo, Guitar Magazine YouTube Channel, Aug. 7, 2017, https://www.youtube.com/watch?v=vHTpXfYsjVg.

Stark, A.M., "Real-Time Beat-Synchronous Audio Effects," Conference: Proceedings of New Interfaces for Musical Expression (NIME 2007), Jun. 2007, Association for Computing Machinery, New York, NY, USA.

Laroche, Jean, "Estimating tempo, swing and beat locations in audio recordings," Proceedings of the 2001 IEEE Workshop on the Applications of Signal Processing to Audio and Acoustics, Oct. 24, 2001, pp. 135-138, New Platz, NY, USA.

Official Action for U.S. Appl. No. 17/152,702, dated Mar. 24, 2021.

* cited by examiner

INTELLIGENT CABLE ADAPTER DIGITAL SIGNAL PROCESSING SYSTEM AND METHOD

BACKGROUND OF THE INVENTION

Before the personal computer was available to the masses and home recording took off, audio effects such as reverb, delay, chorus and other audio effects could usually only be added to an audio signal using professional equipment found in recording studios by manufacturers such as Solid State Logic, Neve, and Lexicon. Companies such as Eventide, Line 6, Hotone Audio, Ibanez, Roland, BOSS, DOD, and Korg, among numerous others, eventually developed these effects for mass production and housed the effects in either analog or digital pedals (stompboxes), or other effects units—most of which have been available in one form or another for at least 40 years.

FIG. 1 shows how musicians often use multiple pedals/stompboxes (one pedal/stompbox shown) 103 to add audio effects to the audio signal from an instrument 101 (or microphone) connected via an audio cable 102 such as a TS/TRS/instrument/speaker cable, an XLR cable, as well as other cables that can carry an audio signal. The processed audio signal is then sent to an output device such as an amplifier 106, PA system 105, or recording device via a second audio cable 104. Recent innovations allow a guitar pedal's 103 audio effect algorithms to be updated via a Bluetooth connection 107 between the pedal and an app (lication) on a smartphone 108. An example of this type of audio effects pedal is the Hotone XTOMP Bluetooth Modeling Effects Pedal. A smartphone app enables the musician to send audio effect algorithms to the pedal. Only the audio effect algorithms are sent to the pedal, not the parameters of the algorithms. Parameter changes are made via knobs on the pedal. Further, sending the audio effect algorithm to the pedal takes about 30 seconds. This pedal also requires an external power source.

The U.S. Pat. No. 9,812,106 patent records a piece of audio (such as a voice from a microphone or a guitar sound from a guitar) in a tablet, extracts parameters from the audio (such as frequency characteristics and phase analysis), and sends the audio parameters via an app to a wireless/Bluetooth pedal where an audio parameter can be used to modify an incoming audio signal. This method of sampling audio to create an audio effect appears to have no professional music recording utility (other than to create unusual sounds) over the current technology which includes thousands of digital reverb (algorithms), digital delay effects, distortion effects among numerous others, which are currently found in relatively inexpensive downloadable apps (such as ToneStack by Yonac Inc., AmpliTube by IK Multimedia, Bias AMP 2 by Positive Grid and Mobile POD by Line 6) or found in music software plugins (such as those manufactured by Waves Audio, Universal Audio, Native Instruments, IK Multimedia and others) used in a typical home or professional recording studio. These apps and plugins obviate the need, or even the desire, for musicians to spend time creating new audio effect algorithms based on sampling their own sounds. In addition, there are numerous companies who offer extremely high-quality audio effect algorithm plugins for free, such as Valhalla DSP, TAL Software and numerous others. Other companies, such as Ignite AMPS, make audio effect algorithms specifically for guitars and basses. With the '106 patent, the musician is required to perform the additional steps of recording and sampling a piece of audio to create audio effect parameters.

This would also require more processing power from the DSP on the tablet as well as drain the tablet's battery life. Furthermore, the '106 patent requires the musician to purchase and carry an additional pedal and cable.

BRIEF SUMMARY OF THE INVENTION

As shown in FIG. 2, the iCable 201 is a specialized instrument or audio cable with built-in Digital Signal Processor (DSP) and wireless capabilities that enable a user to wirelessly receive audio data and apply it to an incoming audio signal within the cable itself. For a musician, the iCable enables a drastic simplification of equipment and enhanced portability. As shown in FIG. 6, Pedal Effects Mode 601 in the iCable app wirelessly transfers audio effect algorithms (such as reverb, delay, chorus, and/or distortion) and parameter settings (such as reverb mix, reverb size, and distortion level) to the iCable, saves the settings in audio effects presets (4 presets shown) such as Preset 1 610, and applies the audio effects to the audio signal coming into and passing through the iCable. Additionally, the musician can wirelessly import 607 presets into iCable app or export 608 presets from the iCable app to share with others. After presets are imported to the app, for example, from another musician, the presets can then be transferred to the iCable.

As shown in FIG. 2, the musician first downloads the iCable app onto her smartphone/tablet/computer 211. Next, the musician plugs in one end of the iCable 201 into her instrument 203 or a microphone 202 and the other end into an output device such as an amplifier 205, PA system 204, or recording device and powers on the iCable 201. When the iCable 201 is powered on, the iCable app can wirelessly connect to the iCable via a Wi-Fi or Bluetooth connection 209 by either initiating the connection from the app on the smartphone/tablet computer 211 or pressing a button on the iCable 201. After the connection to the iCable 201 is established, the musician can choose an audio effect or a combination of audio effects (audio effects chain) and adjust their individual parameters in the iCable app whilst playing her instrument 203 (or singing into her microphone 202). When the musician is satisfied with the sound of her instrument 203 after application of the audio effects, she can save the audio effects as presets in the iCable app on the smartphone/tablet/computer 211. When any parameter change is made within the iCable app, the change is automatically sent in real-time to the iCable 201. The change to the iCable 201 is initially a temporary setting to enable the musician to experiment with the adjustments to the audio effects. When the musician is satisfied with the adjustments, the musician can save the changes in the iCable 201. After the presets are stored in the iCable 201, the musician can then switch between audio effect presets from the app or by using an external controller such as an iPedal 206 or iClip 207 or a button on the iCable 201 itself.

Most musicians carry with them numerous audio effects units (such as stompboxes/pedals) along with corresponding audio cables (for every pedal, the musician needs two separate instrument cables as well as an independent power source) for live performance or recording. This can get very cumbersome and costly. Because the iCable 201 will have all of the audio effects capabilities built into it, all the musician will need to bring to a performance or recording is the iCable 201 and their smartphone 211. For further convenience, the musician may also use other optional "iCable enabled" controllers such as the iPedal 206 and/or the iClip 207 as discussed in detail below. In doing away with multiple stompboxes/pedals and corresponding audio cables, as well as housing the audio processing technology of the iCable within the cable itself, the iCable represents a new paradigm in live musical performance and recording: No extra cables, no extra pedals, no extra power sources. Significantly, the iCable also levels the playing field within the music-making ecosystem, by allowing musicians without a lot of disposable income to compete with those musicians who can afford to purchase numerous foot pedals/stompboxes and corresponding audio cables. For example, it is not uncommon for a typical guitarist or bassist to carry 5-10 pedals/stompboxes to performances in addition to all of the extra instrument cables needed to connect the pedals as well as corresponding batteries or power supply units. Instead of needing to buy additional audio effects pedals, the iCable app can allow the musician to simply download additional audio effects she chooses to use directly into her iCable 201.

Optional equipment of the iCable system includes an iClip 207, an iPedal 206, or as shown in FIG. 5, an iCable adaptor 501. In one embodiment, an iCable adapter 501 houses the invention instead of the cable. This allows musicians to easily turn their existing passive instrument or microphone cable into an iCable using a detachable iCable adapter 501 that houses all of the iCable circuitry. The iClip 207 and/or iPedal 206 wirelessly connect to the iCable 201 and allow the musician to wirelessly 208 switch between audio effect presets saved within the iCable 201. FIG. 4 shows that the iClip 401 is a small device placed, in the preferred embodiment, on the guitar headstock 402 that can be positioned proximate to or in precisely the same place of a digital guitar tuner (or can be placed on another area of a different stringed instrument) allowing the musician to operate the iClip in a familiar location while switching between the audio effect presets by tapping small buttons 403. The iClip 401 circuitry may also be incorporated into a digital tuner or have a digital tuner incorporated into it. As shown in FIG. 2, the iPedal 206 is a small foot pedal/switch allowing the musician a familiar location and process to switch between the audio effect presets by tapping on foot switches.

The iCable can also be used as either a looper/discreet multi-track recording unit as well as a background track playback device. As shown in FIG. 7, Looper Mode 701 in the iCable app allows multiple audio loops/overdubs (4 loops shown) to be recorded and played within the iCable while the musician's audio (e.g., guitar) signal is simultaneously processed within the iCable using audio effects. As shown in FIG. 8, Song Import Mode 801 in the iCable app wirelessly sends to the iCable pre-recorded songs or audio selections (4 songs shown) 802 to play alongside the audio signal processed by the iCable.

This invention may also be able to be used for other non-music related applications, such as different types of digital or analogue data that a cable might carry such as video data.

BRIEF DESCRIPTION OF THE DRAWINGS

Illustrated in the accompanying drawing(s) are embodiments of the present invention In such drawings.

The above-described drawing figure illustrates the described apparatus and its method of use in several preferred embodiments, which are further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

DETAILED DESCRIPTION OF THE INVENTION

Figure 6:
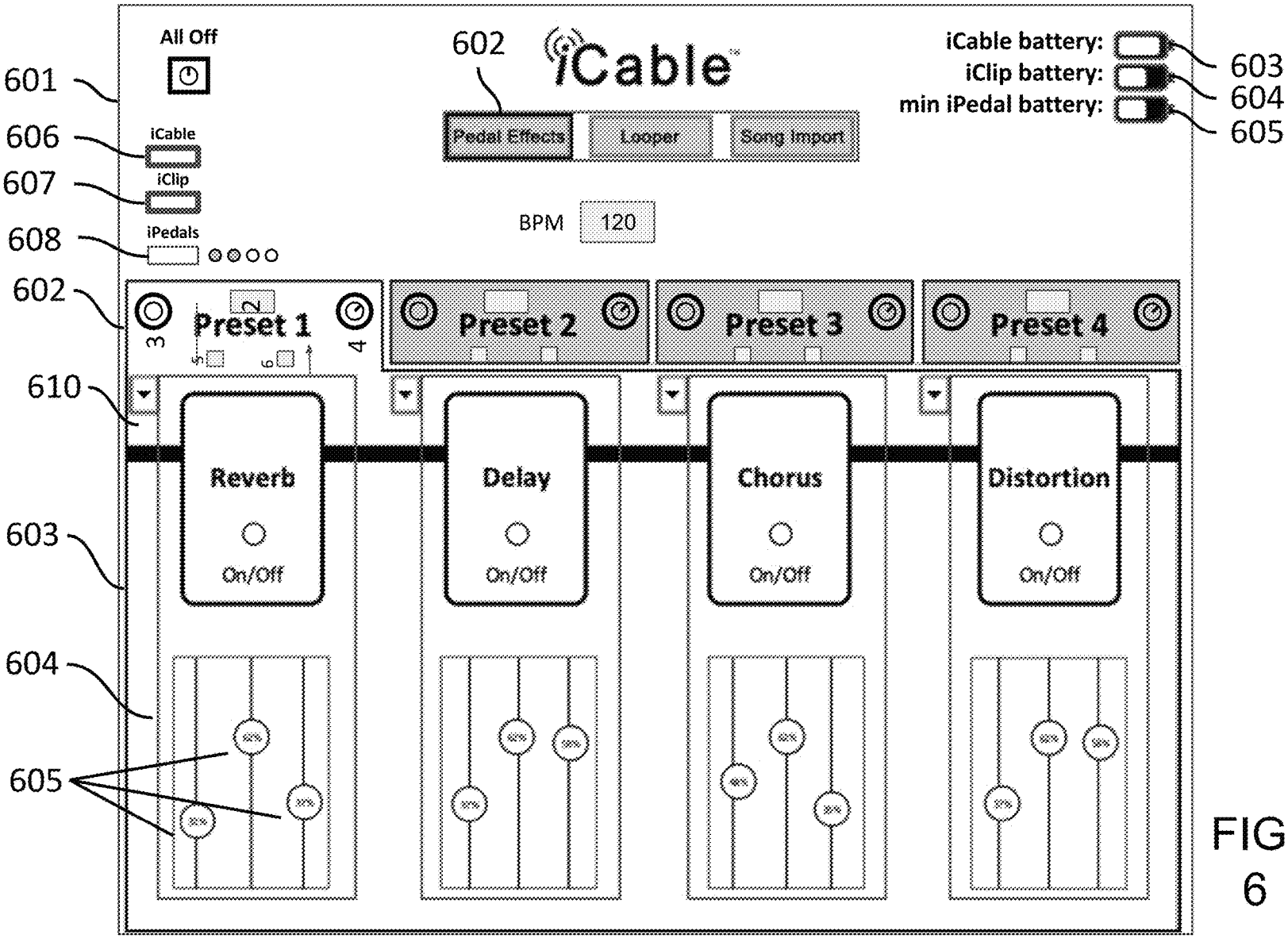
FIG. 6 shows an example of a graphical user interface for the iCable app in Pedal Effects Mode on a smartphone/tablet/computer.

The musician first downloads the iCable app onto her smartphone/tablet/computer. As shown in FIG. 6, the first interface in the iCable app is Pedal Effects Mode 601 which is selected by pressing the Pedal Effects button 602. Pedal Effects Mode 601 functions like any other smartphone audio effects app (such as IK Multimedia's AmpliTube) in that the iCable app allows the user to: (i) choose between numerous audio effects (such as reverb, delay, chorus, or distortion); (ii) choose the order of the effects; (iii) adjust effect parameters (such as reverb level and reverb tail length) for each of the audio effects; and (iv) download new audio effects into the iCable app. Unlike other smartphone audio effects apps, the iCable app also: (i) shows battery life of the iCable, iClip, and iPedal(s) 603; (ii) syncs with the iCable (discussed further below); (iii) shows iCable wireless connection status 604, iClip wireless connection status 605, and iPedal connection status 606; (iv) optionally, connects to an external controller such as the iClip and iPedal; (v) imports/exports audio effect presets; and (vi) imports recorded audio directly from the iCable. Additionally, the iCable app can be configured to not just send to the iCable different types of audio (processing) effects algorithms, but video effects algorithms to process video information as well.

Figure 1:
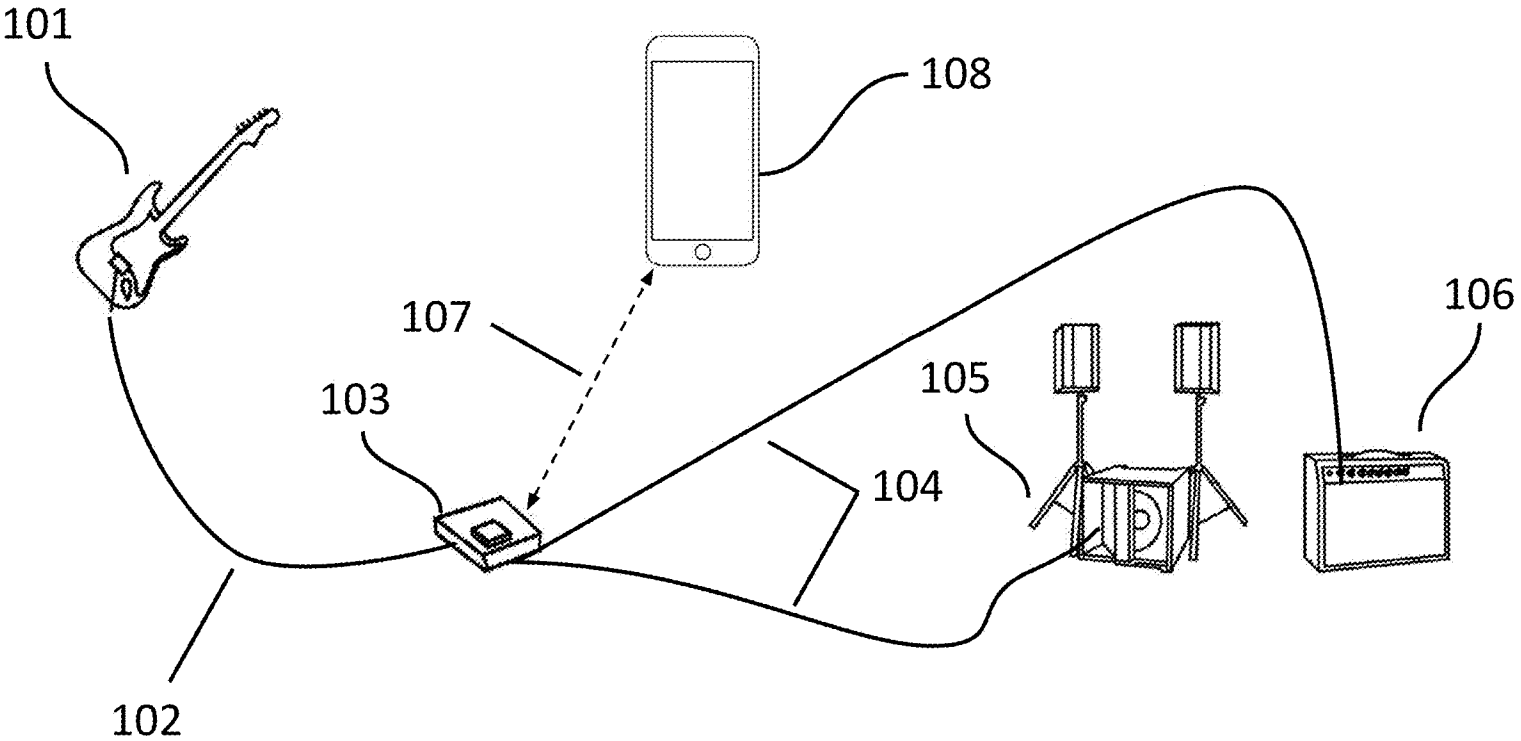
(PRIOR ART) FIG. 1
FIG. 1 is a diagram showing the prior art.
Figure 2:
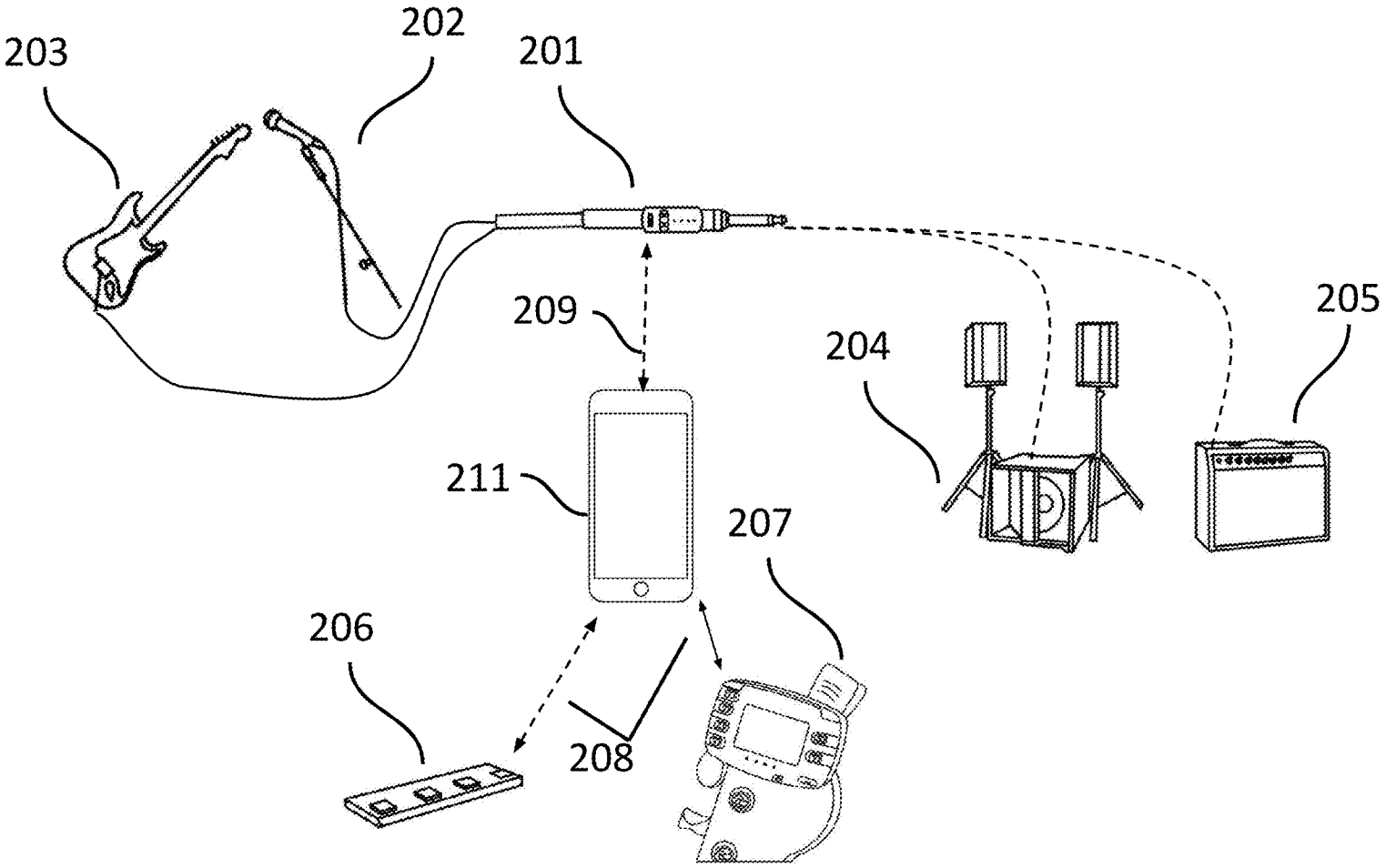
FIG. 2 is a diagram showing an overview of the iCable DSP Wireless System.

Next, as shown in FIG. 2, the musician plugs in one end of the iCable 201 into her instrument 203 and the other end into an output device such as an amplifier 205, PA system 204, or recording device and powers on the iCable 201 by pressing an On/Off switch on the iCable 201 such as the MINI micro slide switch.

The iCable 201 circuitry is housed within an audio cable such as the Mogami Overdrive Platinum Guitar Cable or a detachable audio cable adapter such as the Neutrik NP2x. The iCable 201 or iCable adapter contains: an input amplifier, an analog to digital converter, a Digital Signal Processor (DSP), memory, a rechargeable Li-ion battery, a battery charger controller, status LEDs, a USB-C input jack, an On/Off switch, an iCable microcontroller (MC), software that runs on the iCable microcontroller, a Wi-Fi/Bluetooth access point, a digital to analog converter, and an output amplifier.

When the iCable 201 is powered on, the iCable app on the smartphone/tablet/computer 211 wirelessly connects to the iCable 201 via a Wi-Fi or Bluetooth connection. The iCable may also have wireless capability built-in that allows the iCable 201 the ability to create its own local Wi-Fi network (independent of any local Wi-Fi signal). By using its own wireless local network, the user is able to wirelessly control audio effects (such as reverb, delay or distortion) on the iCable 201 by any iCable-enabled wireless controller connected to its local network. A local Wi-Fi access point (LWAP) is created in the iCable with a Wi-Fi/Bluetooth module such as the Murata Shielded Ultra Small Dual Band WiFi 11a/b/g/n+Bluetooth 5.0 Module. The iCable app connects to the LWAP using the standard Wi-Fi menu of available networks on the smartphone/tablet/computer 211. Alternatively, a wireless Bluetooth connection can be used as well. Although Wi-Fi is more stable over long distances, a reason to use Bluetooth over Wi-Fi is that the Bluetooth standard (called Bluetooth Low Energy) uses, as its name implies, low energy. This would extend the battery lifecycle of the iCable. The iCable app uses the wireless connection to wirelessly (i) send algorithms/parameters/commands to the iCable; (ii) receive battery status 603 and wireless connection status 604, 605, 606 from the iCable, iClip, and iPedal(s); (iii) send audio to the iCable in Song Mode (discussed below); (iv) receive recorded audio from the iCable in Looper Mode (discussed below); and (v) receives modified audio effect presets that have been modified from an external controller.

The iCable will also display the wireless connection status with the iCable app. A blinking blue light on the iCable indicates that the iCable is attempting a Wi-Fi or Bluetooth connection with the iCable app. A solid blue light indicates an established Wi-Fi or Bluetooth connection. Thus, the iCable app always shares the same wireless connection status of the iCable. While a wireless connection between the iCable and iCable app is preferred, this may also be a wired connection through a cable such as a USB-C cable.

Pedal Effects Mode

As shown in FIG. 6, in one embodiment, the iCable app has three modes 602 that can be selected by the musician: Pedal Effects Mode 601; Looper Mode; and Song Import Mode. FIG. 6 shows an example of a graphical user interface for the iCable app in Pedal Effects Mode 601 on a smartphone/tablet/computer.

After the connection to the iCable is established, Pedal Effects Mode 601 enables the musician to choose audio effect algorithms (such as reverb, delay, chorus, and/or distortion) and adjust audio effects parameters in the iCable app whilst playing her instrument (such as reverb length, distortion level, and chorus depth). Parameter changes made within the iCable app are automatically sent in real-time to the iCable which enables the musician to experiment with her desired sound while making adjustments to the audio effects whilst playing her instrument.

In the preferred embodiment, there are four audio effect algorithm presets (could be more or less; four presets shown—Preset 1 610, Preset 2, Preset 3, and Preset 4). Each preset can have up to four audio effect algorithms (could be more or less; Reverb 620, Delay, Chorus, and Distortion shown). Each audio effect algorithm has an audio effect algorithm settings interface comprised of adjustable parameters 630. For example, the Preset 1 610 has four audio effect algorithms (Reverb 620, Delay, Chorus, and Distortion) each of which have their own adjustable parameters 630.

As shown in FIG. 6, the musician first selects a preset such as "Preset 1" 610. Then the musician selects up to four audio effect algorithms to use by clicking on the drop-down menus 622. The musician also selects an order in which the audio effect algorithms are applied by dragging the audio effect algorithms (such as Reverb 620) to the desired location within the preset 610. Audio effect algorithms are applied in order from right to left in Pedal Effects Mode 601 of the iCable app. As an example, the musician might choose to apply Delay 621 before Reverb 620 instead of Reverb 620 before Delay 621 as shown. Next the musician adjusts parameters 630 by sliding the parameter controls up and down. Preset 1 610 shows the following parameters: Reverb Mix=32%; Reverb Size=62%; Reverb Reflection=37%; Delay Mix=37%; Delay Time=62%, Delay Feedback=58%; Chorus Level=48%; Chorus Rate=62%; Chorus Depth=35%; Distortion Level=37%; Distortion Tone=62%; Distortion Drive=58%.

When any change is made to a preset within the iCable app (such as insertion of a new audio effect algorithm, a change to the audio effect algorithms application order, or a change to any of the audio effect algorithm parameters 630), the change is automatically sent in real-time to the iCable and the changed audio effect preset 610 in the iCable app visually indicates that a change was made by blinking the preset label ("Preset 1") 609, flashing in the preset tab, or displaying a blinking light. The change to the iCable is initially temporary to enable the musician to experiment with the adjustments to the audio effects. When the musician is satisfied with the adjustments, the musician can overwrite any stored settings for a particular preset by pressing the preset label ("Preset 1") 609 for several seconds until the it stops blinking. This stops the visual indicator (indicating a change has been made) from flashing or blinking.

The musician can download or import another musician's audio effect presets to her iCable app by clicking on the Import Pedal Effects button 607 on a particular preset. To use the downloaded audio effect presets along with their corresponding settings, the recipient would need to have those same audio effect algorithms stored on their iCable/iCable app. In one embodiment, the audio effect presets comprise only the audio effect parameter settings. If a user does not have the audio effect algorithms related to the preset's audio effect parameter settings installed in her app, she will receive a pop-up window notifying her of this and, optionally, asking her to locate or purchase the needed audio effect algorithm(s). In another embodiment, the audio effect presets comprise the audio effect algorithms as well as the related audio effect parameter settings. The musician can also upload or share specific, customized presets of her audio effect algorithm preset settings by clicking on the Export Pedal Effects button 608 on a particular preset.

In one embodiment, the preset labels can be changed. For example, "Preset 1" could be changed to "Reverb+Dist." or "Hot Blues Solo".

Figure 3:
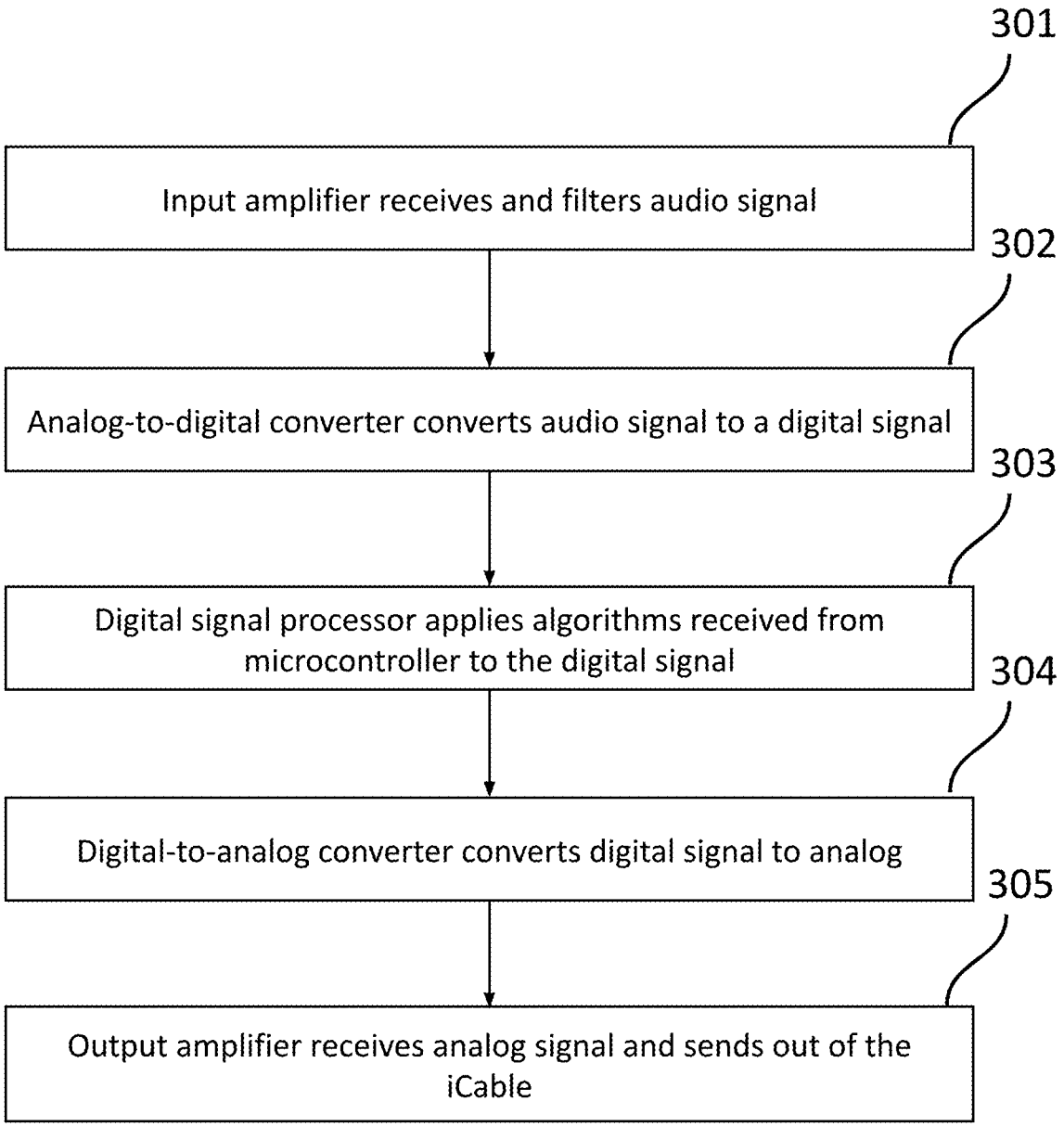
FIG. 3 is a process flow diagram showing how the iCable processes audio data.

FIG. 3 shows the process of one embodiment for the iCable processing audio data. In the iCable circuitry, housed within the iCable or iCable adapter, at step 301, the first component that receives the audio signal is the audio input amplifier such as the Texas Instruments TL072 which: (i) filters the input audio signal; (ii) adjusts the filtered audio signal to standardized or appropriate volume levels (known as line levels); and filters out any unnecessary frequencies.

At step 302, the adjusted audio signal is sent to the 12-bit analog-to-digital converter (ADC) such as the Texas Instruments PCM4201 having a sample rate of at least 128 Kbps (kilobits per second) (equivalent to CD-ROM audio quality) where it is converted to digital data. ADCs transform an analog voltage to a binary number (a series of 1's and 0's.). The number of binary digits (bits) that represents the digital number determines the ADC resolution. However, the digital number is only an approximation of the true value of the analog voltage at a particular instant because the voltage can only be represented (digitally) in discrete steps. How closely the digital number approximates the analog value also depends on the ADC resolution. A 12-bit ADC has a resolution of one part in 4,096, where $2^{12}$=4,096. Thus, a 12-bit ADC with a maximum input of 10 VDC can resolve the measurement into 10 VDC/4096=0.00244 VDC=2.44 mV. More information about analog to digital conversion can be found in Measurement Computing's Data Acquisition Handbook. The ADC also has a sample rate which is how many times per second the audio signal is sampled. Thus, a greater sample rate will yield better audio quality.

After the analog audio signal is converted to digital, at step 303, the digital signal can be manipulated or processed by algorithms in the DSP. The specific DSP that is needed should ideally be a digital audio signal processor such as Analog Devices ADSP-21573 because it is specifically designed to process audio applications in the digital domain.

Algorithms and algorithm parameters are loaded on the DSP. For example, if the musician wants to add reverb to an audio signal, the parameters (i) "reverb level/amount" or (ii) "reverb tail length" (how long the actual reverb extends before it decays) would be sent as well as the reverb algorithm that uses the foregoing parameters. The iCable microcontroller such as the STMicroelectronics STM32F4 Series MCU delivers the parameters and algorithms to the DSP for executing the audio manipulation of the audio signal from the instrument. Alternatively, a more powerful iCable microcontroller could be used such as the STMicroelectronics STM32H7 which not only functions as a system microcontroller, but can also run the algorithms internally potentially obviating the need for a DSP.

The iCable microcontroller runs software that is responsible for handling all communication between the iCable and the iCable app. The iCable microcontroller is also responsible for (i) configuring the DSP in the iCable, (ii) running a "self-test" upon "power-up" to confirm that the iCable is operating normally, and (iii) monitoring the iCable, iClip, and iPedal battery and wireless status.

Upon power up, the software on the iCable microcontroller performs a built-in test/process to make sure that all of the hardware in the iCable is functional and connected properly. The iCable microcontroller software tests to make sure that the iCable microcontroller is communicating correctly with the DSP and that the interface is working correctly. The software also communicates with the WIFI/Bluetooth controller and performs a test to access the memory as well as check the internal Li-ion battery status.

The second step the software performs is the initialization of various components. The first item initialized is the DSP. The second item initialized is the Wi-Fi/Bluetooth controller. If no Wi-Fi access point had previously been created, the Wi-Fi/Bluetooth controller tries to create an access point, goes into standby mode, and waits for a smartphone/tablet/computer to connect to it to start receiving commands from the iCable app.

After the connection between the iCable and the iCable app is made, the iCable goes into operational mode where there is constant communication between the iCable microcontroller and the iCable app on a user's smartphone/tablet/computer. The iCable microcontroller sends the iCable wireless connection and battery status to the iCable app on the smartphone/tablet/computer, and the iCable app on the smartphone/tablet/computer in return sends algorithms, commands, and/or parameters back to the iCable. For example, the musician may want to put a new algorithm such as a special convolution reverb in the iCable. To do this, the musician uses the iCable app to select a specific reverb algorithm file on her computer (or elsewhere) and then loads/sends the algorithm file while the iCable connection is active. In the preferred embodiment the audio effect algorithms are only sent to the iCable one time and then stored until they are deleted or replaced. In the preferred embodiment, after an algorithm is stored on the iCable, only the algorithm parameters will need to be sent to adjust that algorithm.

The iCable microcontroller software can also be used to combine several audio effects together at once (e.g., reverb+distortion). These are the kinds of commands and parameters that are sent via the iCable app wirelessly to the iCable microcontroller. Each audio effect algorithm (reverb and distortion) will have its own parameters.

As with traditional effects pedals, the order in which the pedal effects on the iCable app are set up are important. Although it is very subjective and there are no rules, some musicians, for example, set the distortion pedal first, followed by modulation pedals (such as echo, chorus, flanger, tremolo, etc.) so that their distortion pedal receives the cleanest, purest signal from their guitar.

Every time a new command arrives from the iCable app to the iCable microcontroller, these commands are executed immediately by the iCable microcontroller sending updated parameters to the iCable DSP. The iCable microcontroller performs its computations in real-time, then communicates with the iCable DSP by changing the parameters of the audio effects such as the amount of reverb, the amount of delay, etc. In addition, the iCable DSP can access an additional memory component such as the Digi-Key 557-1904-1-ND to assist the DSP in (i) processing large amounts of digital data through the algorithms in real-time as the musician plays her instrument or sings; and (ii) storing numerous audio effect algorithms for real-time access.

After the algorithms are applied to the digital signal by the iCable DSP, at step 304, the digital signal is sent to the 12-bit Digital Audio Converter (DAC) such as the Texas Instruments TLV320DAC3120 where it is converted back to an analog signal. At step 305, the processed analog signal is sent to the audio output amplifier such as the Texas Instruments TL072 and out of the iCable, ready to be input into an output device such as an amplification system (i.e., a guitar or bass amplifier), powered speaker, PA system, music mixer, or a recording device.

When the musician is satisfied with the sound of her instrument after application of the audio effects, she can save the audio effects into one of four (as an example) presets in the iCable app which can later be selected in real-time while performing. In the preferred embodiment, the iCable holds at least four audio effect algorithms (such as Reverb, Delay, Distortion, and Chorus) which can be used in any combination and saved into at least four presets. As an example:

Audio Effect Preset #1
Reverb—Parameter 1, Parameter 2, etc.
Delay—Parameter 1, Parameter 2, etc.
Distortion—Parameter 1, Parameter 2, etc.
Chorus—Parameter 1, Parameter 2, etc.
Audio Effect Preset #2
Reverb—Parameter 1, Parameter 2, etc.
Delay—None
Distortion—Parameter 1, Parameter 2, etc.
Chorus—Parameter 1, Parameter 2, etc.
Audio Effect Preset #3
Reverb—Parameter 1, Parameter 2, etc.
Delay—None
Distortion—Parameter 1, Parameter 2, etc.

Figure 9:
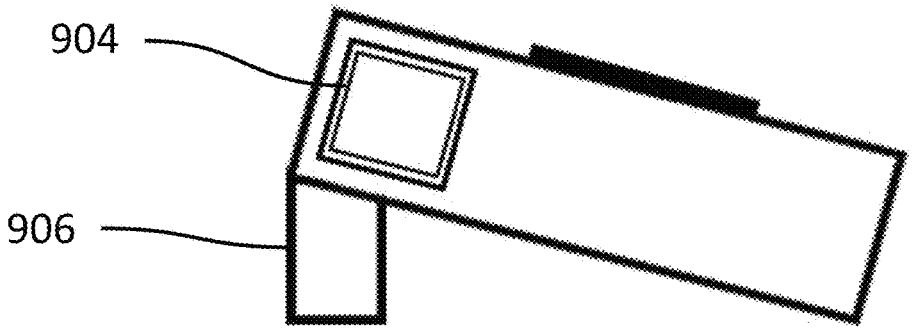
FIG. 9 shows the iPedal's top-down and side views.
Figure 9:
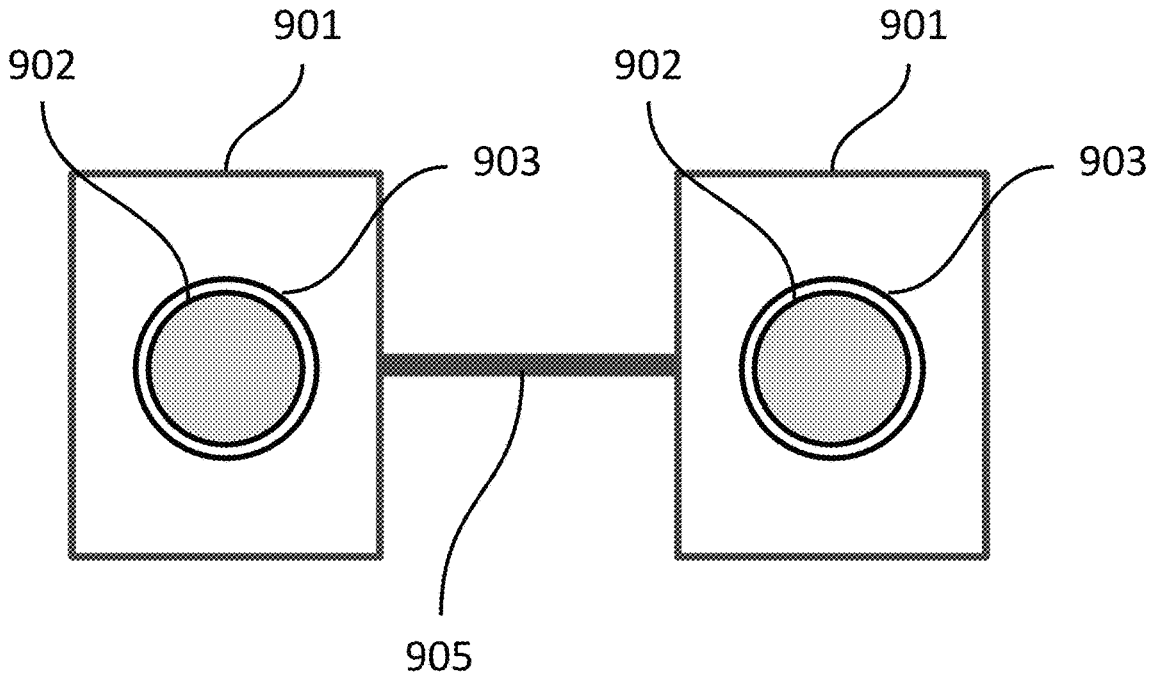

Chorus—None
Audio Effect Preset #4
Reverb—None
Delay—None
Distortion—Parameter 1, Parameter 2, etc.
Chorus—None
External Controller Using the iCable app on the smartphone/tablet/computer to toggle between presets during a live performance might be awkward. Typically, the audience does not want to see a musician looking down at a screen. Eye contact with the audience is an important part of performing which would be lost if looking down at a smartphone/tablet/computer. Further, smartphones/tablets/computers have a tendency to automatically shut off the screen when not used for an extended period of time, then requiring the musician to enter a password to turn on the smartphone/tablet/computer again. Even though it is possible to disable automatic screen shut off, the musician does not need this worry during a performance. Further, leaving a screen on during a performance would be a large, unnecessary battery drain increasing the potential of the smart device running out of power during the performance. Utilizing the present invention, the musician can instead use an external controller such as (i) as shown in FIG. 4, the iClip 401, a small device placed on the guitar headstock 402—in the same place as a guitar tuner (as an example)—allowing the musician a very familiar location to switch between the audio effect presets by simply tapping/pressing one of four buttons 403 representing the 4 presets stored in the iCable; or (ii) as shown in FIG. 9, the iPedal 901, a small foot pedal/switch allowing the musician a familiar location to wirelessly switch between the audio effect presets by tapping foot switches 902.

For decades, musicians have used guitar tuners clipped to the headstock of their electric and acoustic guitars, bass guitars, or other musical instruments to tune their instruments. The proximity of the digital tuner to the guitar tuning pegs (the little knobs one turns to tune the guitar string) is very important. The digital tuner is positioned so that the musician does not have to take her eyes off of either the tuner or the tuning pegs for too long. As shown in FIG. 4, in the preferred embodiment, iClip and digital tuner circuitry/hardware are incorporated into the same device in that same location as a digital tuner. Alternatively, the iClip 401 can be placed in a position that is familiar to a musician for her particular instrument. The iClip 401 has a Tuner On/Off button 404 that allows the musician to use the iClip 401 as a tuner.

Figure 4:
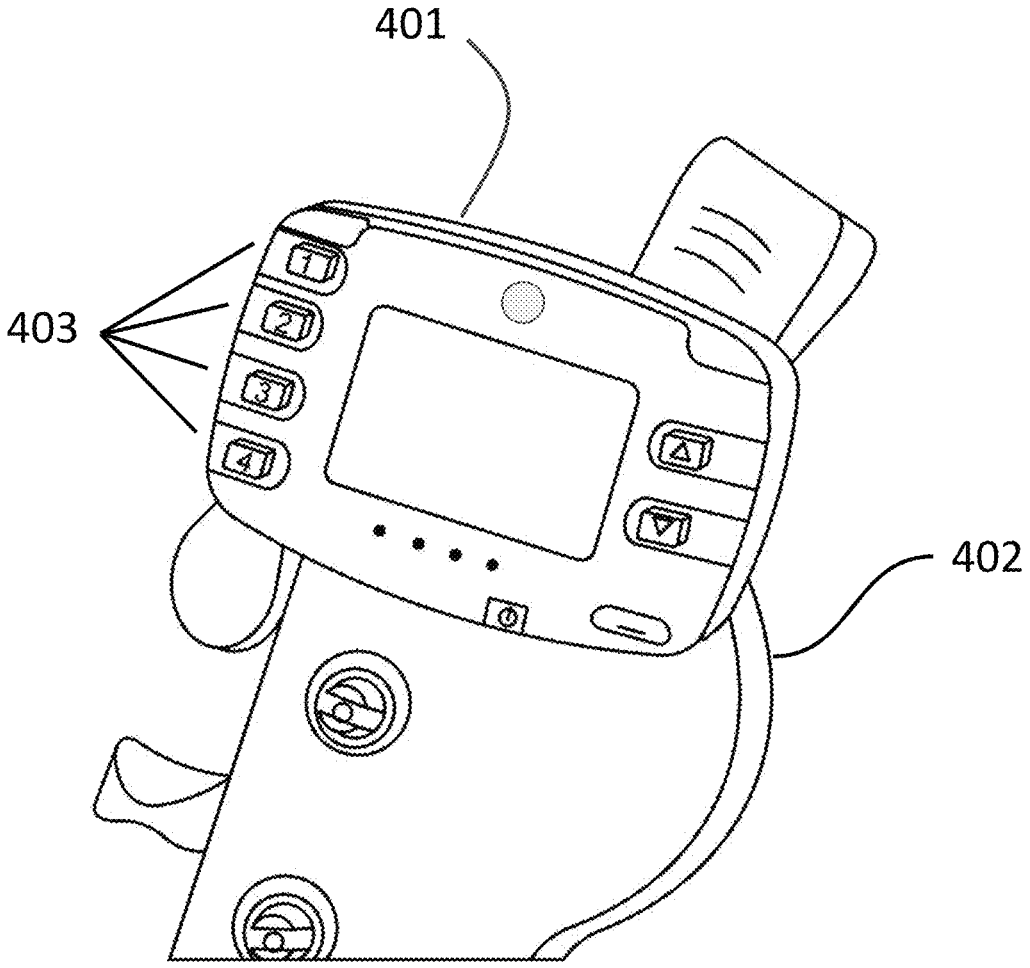
FIG. 4 shows an iClip on a guitar headstock.
Figure 5:
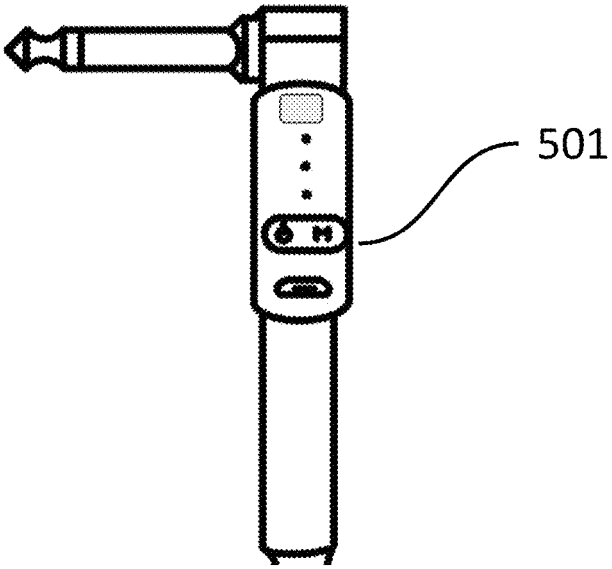
FIG. 5 shows an iCable adapter.

As shown in FIG. 4, a main function of the iClip 401 is to change or toggle through the different preset audio effects previously stored in the iCable using the toggle buttons 403. The musician won't need to use the smartphone/tablet anymore once the parameter-adjusted audio effects are loaded into the iCable DSP because the user can then toggle between the loaded audio effects presets with the iClip 401 or iPedal. The app on the smartphone/tablet/computer won't be needed again until the next time the musician wants to either download new audio effects onto the iCable or to change a parameter of an audio effect in the iCable. For that to take place, the musician would need to use the iCable app within the smartphone/tablet/computer.

In the preferred embodiment, the iClip 401 operates as a wireless controller for the iCable, only allowing the musician to toggle between presets. In an alternate embodiment, the iClip 401 can also adjust audio effect parameters similar to the iCable app. Various mechanisms can be used to make the adjustments such as: (i) physical slider mechanisms, knobs, or buttons; or (ii) the iCable app embedded in the iClip 401, but with a much smaller form factor so that the iClip 401 can fit on the guitar headstock. When audio effect parameter adjustments are made using the iClip 401, the changes can be displayed in real-time on both a small screen 409 on the iClip 401 as well as in the iCable app on a tablet, computer, or other large screen such that the musician can see the adjustments made in real-time without looking down at the iClip 401 while playing the guitar. The musician could walk up to a larger screen during a live performance and make parameter adjustments with the iClip 401 and see those parameter adjustments appear in real-time on a larger screen.

When any change is made from the iClip 401 to a preset (likely during a sound check, performance, or rehearsal when the musician does not have access to the iCable app), the change is automatically sent in real-time to the iCable and the preset number 403 on the iClip 401 flashes red to visually indicate that a change was made. The change to the iCable is initially temporary to enable the musician to experiment with the adjustments to the audio effects. When the musician is satisfied with the adjustments, the musician can overwrite any stored settings for a particular preset in the iCable by pressing the corresponding iCable preset number 403 on the iClip 401 and holding it for a few seconds until it stops flashing.

When the musician returns to the iCable app in the smartphone/tablet/computer (after the performance), the iCable app will compare the date stamps of the parameter changes on the iCable to the parameters in the iCable app. If the date stamp is later on the iCable then that on the iCable app, a window will pop up notifying the musician that there has been a change to a preset in the iCable and prompting the musician to overwrite the preset in the iCable app so that there is parity between the iCable and the iCable app. The iCable will always store the latest audio effects parameter changes.

In an alternate embodiment, the iClip 401 may also store the adjusted audio effects. This would require the iClip 401 to have an internal DSP.

The iClip 401 can operate either as part of a local WiFi network, such as the WiFi network created by the iCable, or as part of a Bluetooth connection or other wireless protocol. An advantage of using WiFi for the iClip is that the iCable is able to act as a WiFi access point and numerous devices such as the iClip and iPedal can connect to it. Also, WiFi has a larger range than Bluetooth. A disadvantage of using WiFi for the iClip, however, is that if the smartphone is connected to a WiFi Network, the smartphone will not be able to access another WiFi network using standard software. Also, because WiFi uses more power, it will drain the iClip battery faster. Using Bluetooth for the iClip would use less power and keep the WiFi connection open for other uses on the smartphone. Bluetooth is also very stable and easy to configure.

With Bluetooth, however, signal dropouts often occur if there is movement of one or more of the Bluetooth devices or if there is no line-of-sight between the two devices.

The actual Bluetooth connection between the iClip and the iCable is made by clicking a button on the iCable which will send a signal that the iClip will find (both on its screen and via a blinking LED) after which the user can simply click on the appropriate button to accept the iCable's Bluetooth signal. In another embodiment, the iCable app would be able to connect the iCable with both the iClip and iPedal(s). In another embodiment, as shown in FIG. 4, the iClip will have a Bluetooth connect button 406 which will allow it to connect to the iCable and iCable app as well. The iCable app always shows wireless connectivity. The preferred embodiment has 3 masters (iClip, iPedal, and the iCable app) with the iCable as a slave.

Once the connection between the iClip 401 and the iCable is made, the iClip screen, the iCable app screen 601, and the LED on the iCable will show that the connection is active. With an active connection, the iClip 401 allows the user to toggle between audio effects presets stored in the iCable by simply pressing the small toggle buttons 403.

In the preferred embodiment, the musician would use both the iClip and the iPedal. Depending on the style of music being played, the musician may decide to only use or need the iClip to change to a different preset within a song. However, if the musician is required to play both rhythm and lead sections of a song, then that player would benefit from having the convenience of both the iClip and iPedal to make it easier for her to choose rapidly—in real-time, between where her hand could reach or where her foot could reach easily to make a preset change. For most musicians, however, the iClip should be sufficient to change presets within a song during a performance or recording.

As shown in FIG. 9, the iPedal 901 has a pedal button 902 on top with a halo light 903 and a connector port 904 on each side. The iPedal connector arm 905 expands from 1-3 inches. The connector arms can expand much like the Sandao Retractable Teacher's Telescopic Pointer. The aluminum casing of the connector arm 905 could also be flexible to allow the musician to connect several iPedals in a semi-circle for easy access. Each iPedal would be sold with a single connecter arm 905 which would snap into the connector port 904 on either side of an iPedal 901. A retractable built-in stand 906 enables the iPedal 901 to tilt to make it easier for the musician to press while standing and playing her instrument. In one embodiment, the angle of the built-in stand 906 is adjustable. In another embodiment, the iPedal 901 is built at an angle.

The iPedal 901 has a Bluetooth connect button 907 which allows it to connect to the iCable and iCable app. Once the connection between the iPedal 901 and the iCable is made, the Bluetooth activation light 911 on the iPedal 901 will be solid blue to show the connection is active. The iPedal's battery is charged through the charger port 908 which can also be used to power the iPedal 901. The iPedal 901 is powered on by pressing On/Off button 909. The battery status light 912 indicates when the battery is charged (solid green), low (yellow), not charged (red), or charging (flashing red, yellow or green).

The iCable app recognizes each new iPedal as they wirelessly (Bluetooth or LWAN) connect to the iCable. Pedal effect presets/loops/songs can be assigned to the iPedals in the iCable app. In the preferred embodiment, the iPedals are modular—that is, each iPedal can be configured to work with a specific audio effect preset within the iCable. In an alternate embodiment, numerous commands can be given to a single iPedal such as "Click twice for Preset 2" or "Click three times for Preset 3".

To assign a specific preset to a particular iPedal, the musician clicks on the arrow associated with the foot icon 612 in the preset that the musician wants to assign. The musician selects the iPedal to be associated with that preset. For example, she can assign Preset 1 610 to a first iPedal and Preset 2 to a second iPedal and so on. In one embodiment, the user can also assign an iPedal to be used as a looper pedal or a song playback pedal (as discussed in detail below).

In the preferred embodiment, audio effects applied by the iPedal take precedence over audio effects applied elsewhere—by the iCable, iClip, or the iCable app. When a musician clicks on an iPedal, the audio effect preset assigned to that particular iPedal will activate, turning off any previously applied audio effects. When the musician clicks again on that iPedal, the preset for the iPedal will stop and the iCable will revert to the previously applied audio effects. For example, the musician first assigns Preset 2 to the iPedal in the iCable app. Then, if Preset 1 was previously selected by the iClip and the musician now presses the iPedal button 901, then Preset 2 will be applied instead of Preset 1. Then, if the iPedal button 901 is pressed again, the iCable reverts to applying the audio effects in Preset 1.

The iCable will always hold the latest audio effects presets. Upon connection to the iCable, the iCable app will compare the date stamp of any modified audio effects in the iCable to the date stamp of any audio effects that are currently stored in the iCable app. If the date stamp of an audio effect in the iCable is of a later date than the date stamp of the audio effect in the iCable app, the iCable app prompts the user to determine if she wants to overwrite the audio effect parameter settings in the iCable app for that particular audio effect preset stored in the iCable.

The remaining components in the iCable are the rechargeable Li-ion battery or other type of battery, with corresponding battery charger controller, status LEDs, and a USB-C connector.

A rechargeable Li-ion battery such as the LiPo Battery 300mAh+ with corresponding battery charger controller such as the Analog Devices LTC4053-4.2 is used so that the iCable can be self-powered without needing an external power source.

One or more Status LEDs such as the Kingbright APFA3010SURKCGKSYKC are also included on the iCable to show the status of the iCable in situations such as: (i) a blinking green (or other color light) when the iCable is charging; (ii) a solid green light when fully charged; (iii) a yellow light when the iCable does not have much battery power left; (iv) a red light if there is an error within the iCable; (v) a blinking blue light when attempting a Wi-Fi or Bluetooth connection; and (iv) a solid blue light when a Wi-Fi, Bluetooth, or other wireless connection is made. The Status LEDs may be one RGB LED having three or more LEDs in one package or can be three separate LEDs (as an example). Software for the Status LEDs stored on the iCable microcontroller determines the color and activity (blinking, duration of blinking/flashing, etc.) of each Status LED.

A USB-C Connector such as the Amphenol 523-124019282112A is used in the iCable to: (i) charge the iCable internal, rechargeable Li-ion battery at the battery charger controller when the USB-C connector is plugged into its own source of power; (ii) connect the iCable microcontroller for firmware updates to configure the iCable; (iii) connect the iCable microcontroller to load additional algorithms onto the iCable microcontroller memory giving the user the ability to share, receive or purchase third-party algorithms and load those algorithms onto the iCable; and (iv) during manufacturing of the iCable, give the engineers the opportunity to do system testing within the iCable as well as testing and/or diagnosing the iCable for proper status and/or condition.

In the event that the iCable stops working, runs out of batteries, or, importantly, if the musician does not want to use the audio effects on the iCable, the iCable may be used passively as a standard instrument or microphone cable just like how all typical instrument cables are currently used. This allows the musician complete flexibility in using the iCable as either a passive or active instrument cable with no attenuation to their audio signal.

In an alternative embodiment, the present invention may also be used with analog sound effects. Analog sound effects are created by using a combination of transistors, diodes, op amps, integrated circuits, resistors, capacitors, potentiometers, and a power source. Multiple sound effects can be combined in one device and the parameters of that device can be adjusted manually or digitally (similar to the Chase Bliss Brothers Guitar Pedal) with knobs or sliders, or preferably, in the iCable app. In this embodiment, the analog effects components and the above disclosed iCable components could be housed together and located such that the weight of the device would not interfere with instrument play. This analog embodiment may be larger than the digital version, but still would be able to be incorporated in a cable. In this embodiment, digital controls would regulate the variable analog components and output an analog signal.

Looper Mode

Figure 7:
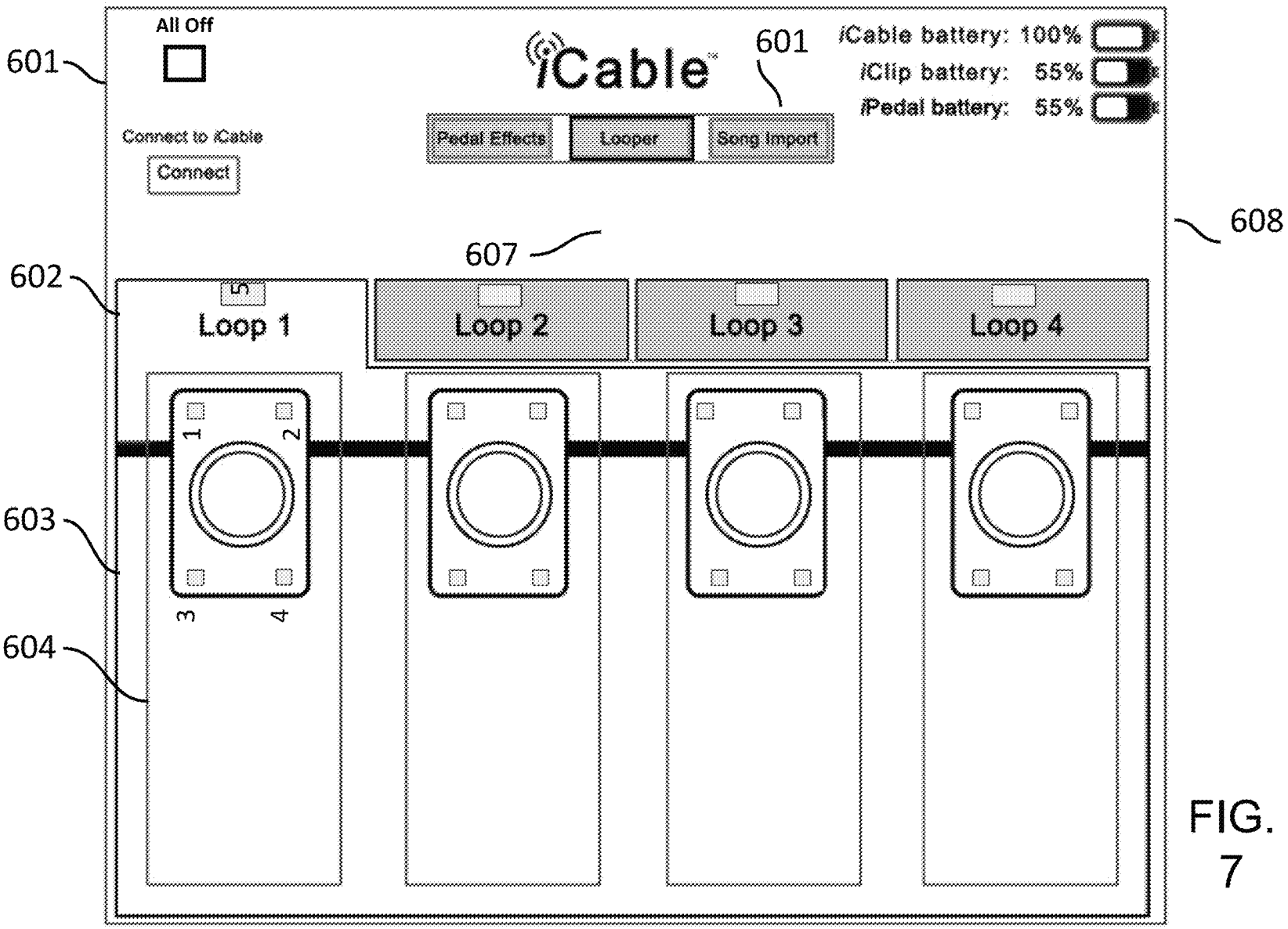
FIG. 7 shows an example of a graphical user interface for the iCable app in Looper Mode on a smartphone/tablet/computer.

The iCable can also be used as a discreet Looper with individualized tracks (much like how a multi-track recording unit records parts on separate tracks). As shown in FIG. 7, in Looper Mode 701, the musician records Loop 1 710. As a musician records/overdubs more recordings with each pass of the loop, each recording is saved on a separate track 711 of audio under the heading of that specific loop, Loop 1 710. All loops/tracks of audio (such as those in Loop 1 710) are played alongside the audio signal passed through and processed by the iCable. For example, in Loop 1 710, there could be eight tracks 711 of audio that were created/recorded by eight different passes of that first looped audio recording.

The interface for each loop such as Loop 1 710 and its corresponding tracks 711 has, at the center, a loop button 720 surrounded by a concentric circle called a halo 721. The color of the halo 721 provides a current visual status of the loop. A white halo 721 indicates that the loop is empty or available to fill. A solid red halo 721 indicates that the loop is currently recording. A green halo 721 indicates that the loop 710 is not empty. The same haloing feature is also displayed on the iClip and on the iPedal. While playing back a loop, the halo 721 light around the corresponding loop button 720 on the iClip, iPedal, and the iCable app will incrementally light clockwise in dark green with a solid light green backdrop to indicate the current position in the loop's duration. For example, if the loop is playing and the halo light 721 is completely light green, it is the start of the loop. Likewise, if the loop is halfway through the loop's length, the halo light 721 will be half lit in dark green with the dark green section of the halo light 721 starting at the 12 o'clock position and stopping at the 6 o'clock position.

To record a loop such as Loop 1 710 in Looper Mode 701, the musician first either: (i) sets the tempo with the tempo slider that pops up when holding down the loop's BPM button 730; or (ii) taps the tempo with the BPM button 730. If the BPM button 730 is pressed more than one time, it is taken as a tempo which adjusts to the speed of the tapping.

The tempo speed (e.g., 120 beats per minute) is visually displayed in the BPM button 730 and in the iClip (in the preferred embodiment) by a flashing red halo light 721 in time to the tempo.

In one embodiment, the recorded loop/tracks are recorded directly into the iCable after which the audio will be sent back to the iCable app. In one embodiment, the iCable syncs its created loops/tracks of audio automatically with the iCable app. In another embodiment, the iCable will compare the date stamps of the loops/tracks in the iCable to the loops/tracks in the iCable app. If the date stamp for a loop is later in the iCable then that on the iCable app (more current), a window will pop up notifying the musician that there has been a change to a specific loop in the iCable and ask the musician to overwrite the loop in the iCable app. The iCable will always store the latest loops/tracks.

To assign an iPedal to be used as a looper pedal, the musician clicks on the arrow associated with the foot icon 712 in the loop that the musician wants to assign.

To start recording, the musician presses the loop button on the iClip, iCable app, or iPedal. As an example, if the musician wants to record Loop 1 710, the musician taps on the loop button 720 of Loop 1 710. The halo light 721 then becomes a solid red to indicate that the iCable is recording. In the preferred embodiment, recording stops when the musician taps the loop button on the iPedal but can also be stopped by pressing the loop button 720 in the iCable app or on the iClip.

When recording stops, the loop/track automatically continues to loop. The current position of the loop playback is displayed in green on the halo 721. To pause the loop, the musician taps twice in succession on loop button 720. From the pause position, if the musician wants to continue playback of the loop, she would click on the loop button 720 once again. While in playback mode if the musician presses the loop button 720 once, the iCable will record a new track within that specific loop. In essence, the looper toggles back and forth between record and playback modes unless double-tapped for pause, after which tapping once again enables playback mode then record mode and so on.

In one embodiment, when the musician is recording in Looper Mode, she is able to continue playing back the loop while switching to Pedal Effects Mode using the app (or mode button 405 on the iClip or another controller device) to choose a different preferred audio effect preset after which she then is able to switch back to Looper Mode to continue to overdub new tracks in her loop if she chooses.

The halo 721 can also be used to fast forward or rewind by touching the halo 721 and sliding one's finger on it to move to the desired position in the song. This clicking routine for recording, playback and pausing, can be used on the iClip and iPedal as well by clicking on their corresponding loop buttons.

The order of the loops can be changed in the iCable app by dragging and dropping a loop such as Loop 1 710 in the iCable app to its desired position.

To delete the contents of any loop, the musician presses the delete button 733 on the app and is prompted to choose whether or not to delete the selected loop and all of its corresponding tracks. A loop and its corresponding tracks can also be deleted by holding down on the loop button 720 for several seconds after which the halo 721 will blink red and then turn white indicating that the loop was deleted. In another embodiment, this clicking routine for deleting can be used on the iClip and iPedal as well by clicking on their corresponding loop buttons (similar to loop button 720) and holding for several seconds.

Once loop recording is finished, each loop with its corresponding tracks can be imported (as an mp3 file or something similar) from the iCable to the iCable app by clicking on the Import Loop Audio from iCable button 731. Once imported into the iCable app, each loop (and its corresponding tracks) can be exported (as an mp3 file or other type of audio file) from the iCable app by clicking on the Export Loop Audio from iCable button 732 after which a pop up will ask the user where she would like to send the recorded audio.

The loop labels such as "Loop 1" can be changed to help the musician easily identify on the loop which becomes important after the creation of a new loop to title the piece of music.

The tracks recorded/overdubbed within a specific loop can be viewed on the iCable app from a dropdown menu 711, where the user can also label the individual tracks prior to exporting them with the Export Loop Audio from iCable button 732. For example, the tracks may be labeled rhythm guitar 1, rhythm guitar 2, lead guitar, etc.

A click track can be generated by the iCable based upon the BPM whose tempo can be controlled by the iCable app, iClip, or iPedal. Click track parameters can include tempo, sound of the click (such as a bass drum or stick hit), and On/Off 734.

Song Import Mode

Figure 8:
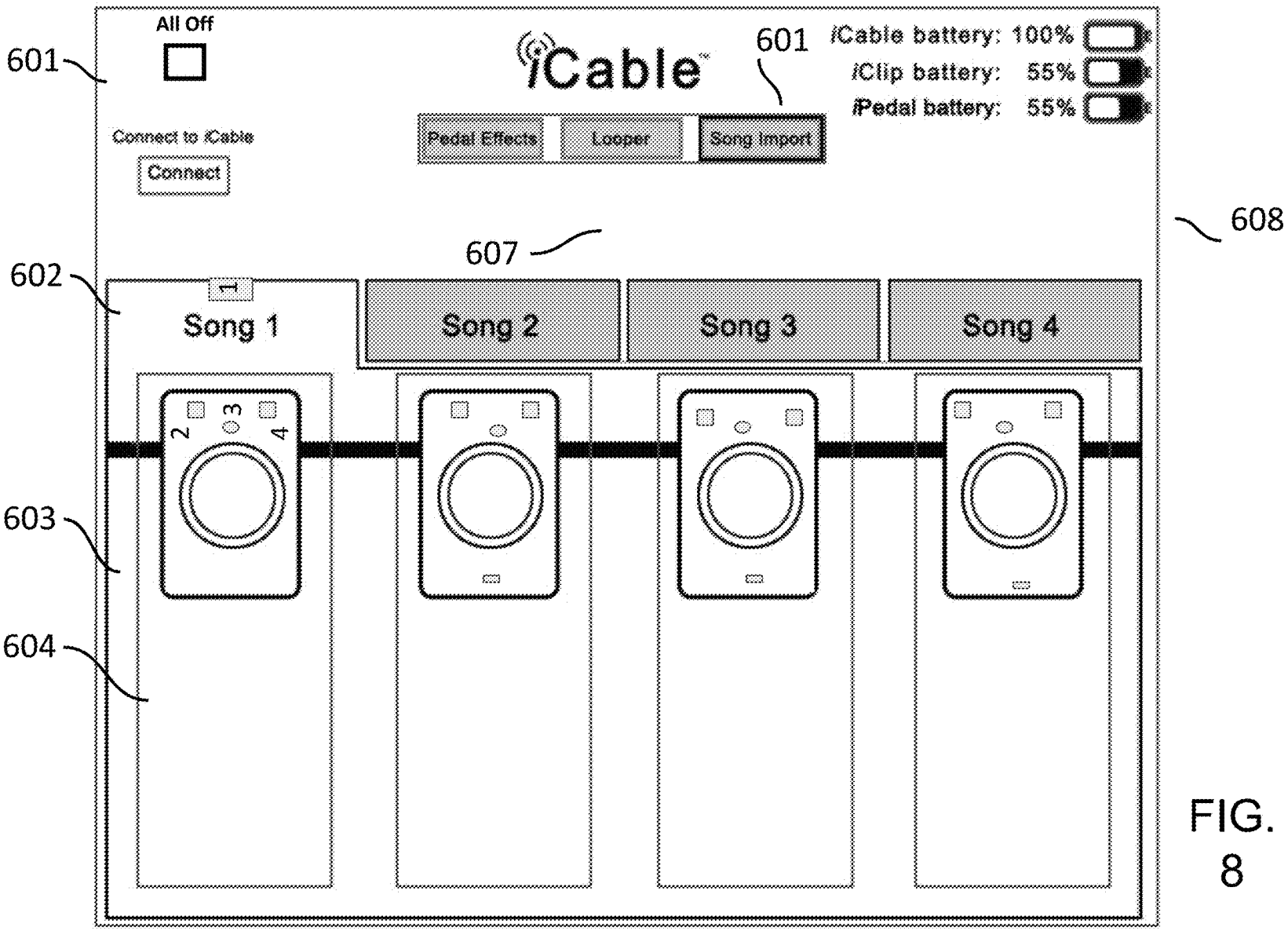
FIG. 8 shows an example of a graphical user interface for the iCable app in Song Import Mode on a smartphone/tablet/computer.

As shown in FIG. 8, Song Import Mode 801 enables a musician to play/sing along with one or more stored background tracks. In Song Import Mode 801, the iCable wirelessly receives background tracks (4 tracks shown—Song 1 810, Song 2, Song 3, and Song 4) which are played alongside the audio signal passed through and processed by the iCable.

The interface Song Import mode has, at the center, a song On/Off button 820 surrounded by a concentric circle called a halo 821 that visually displays playback position of the track and operates in the same manner as the Looper Mode halo.

Using the playback options 830, the musician can: (i) play a single song once; (ii) loop a single song; (iii) play all the songs once; or (iv) loop all the songs as a song list.

To begin playback of a song or songs, the musician clicks the song button 820 from either the iClip, iPedal, or the iCable app. If the song button 820 is clicked again, the song is paused. If the song button 820 is clicked twice fast, the song (or song list) will start replaying at the beginning. The halo 821 is used to fast forward or rewind by touching the halo 821 and sliding one's finger on it to move to the desired position in the song.

To import a song to the iCable, the musician must first import the song to the iCable app by clicking on the Song Import to App button 822 on a particular song. The musician is then prompted to locate and select the audio file to import. Upon importing the desired music into the iCable app, the song's title is automatically updated in the app, after which the app then prompts the user to send the song to the iCable. If the musician chooses to send the song to the iCable, the halo 821 turns from white to green to show a song is now stored in the iCable. If the musician chooses not to send the song at that time to the iCable, the musician can later send it to the iCable by pressing the Export to iCable button 823. The musician can delete a song by pressing the delete button 824 or holding down the song button 820 for several seconds.

The order of the songs can be changed in the iCable app by dragging and dropping a song such as Song 1 710 in the iCable app to its desired position.

To assign a specific song such as Song 1 810 to a specific iPedal or iClip button, the musician clicks on the arrow associated with the foot icon 812 in the song that the musician wants to assign. The musician selects hardware (iPedals, iClip buttons, iCable buttons) to be associated with that song. For example, she can assign Song 1 810 to a first iPedal and Song 2 to a second iPedal and so on.

The labels for the songs in Song Import mode can be changed to help the musician easily identify the imported songs.

Tempo-Adjusted Effects

In one embodiment, the iCable DSP analyzes an incoming audio signal to determine the current tempo/beats per minute (BPM) of the audio passing through the iCable. In another embodiment, the iCable has a microphone that analyzes outside music (music external to the iCable) to determine BPM. Once the BPM is determined, an iCable DSP can globally (or individually) automatically adjust BPM-based effects in the iCable to adjust to the analyzed tempo. Audio effect algorithms that can be based on the tempo or beat analysis of the audio signal may include delay, tremolo, vibrato, reverb among others. As shown in FIG. 6, the automatic beat sensor system button 650 located in each preset is clicked once to select whether to analyze sound from an external source using a microphone in the iCable, or to analyze the audio passing through the iCable. The automatic beat sensor system continues analyzing until it identifies a tempo. When a tempo is identified, two beeps from the iCable let the musician know that the BPM of the effects have been adjusted and the identified BPM displays in the BPM button 651. The BPM of the audio effect preset (all audio effect algorithms in the preset) can also be manually adjusted by clicking and holding a finger on the BPM button 651 to activate a slider which adjusts the BPM of the audio effects in that preset. BPM can also be globally adjusted by clicking and holding a finger on the global BPM button 652 to activate a global BPM slider or tap a tempo. In one embodiment, each audio effect has a BPM tempo lock (not shown) to prevent changes made with BPM button 651 or global BPM button 652. If the musician decides to go back to the original tempo (the tempo before any manual changes were made to the tempo) of an audio effect, she holds down the BPM button 651 or global BPM button 652 for several seconds.

Audio Effects Intensity/Volume Knob

As previously discussed, audio effect combinations are highly subjective. However, it could potentially save a guitarist much time experimenting on preferred combinations if there was a combination of algorithms and algorithm parameters that sound good to the musician across multiple guitar types (nylon string, electric, etc.). Due to the significant differences in sound between different guitars, it is often difficult that one set of algorithms and algorithm parameters can sound good across multiple types of guitars.

Although an audio effects chain is subjective, through years of performing and recording, it has been found, as an example, that an audio effects chain (e.g., Preset 1 610) comprising: compression, overdrive (or distortion), an amplifier simulator, and delay generates a signal that can work with numerous types of guitars with only the intensity (volume) of the combined audio effects (in an audio effects chain) needing to be changed. The original audio effects chain mentioned above was designed to be used to create a rock-sounding guitar solo using a steel-string guitar. However, it happened that a nylon-string acoustic guitar was able to get the same rock sound during the guitar solo as the steel-string guitar by using a send knob (which allows a musician to vary the level of summed audio effects applied to a specific track of music) in Apple Logic Pro X. Since then, the same audio effects chain with varying summed master audio effects levels was also found to work on (i) numerous other types of guitar strings and/or guitar types, regardless of guitar body type (hollow or solid); and (ii) other types of guitars having different internal electronic amplification systems.

First, as shown in FIG. 6, the user either selects or creates an audio effects chain (e.g., Preset 1 610) containing one or more audio effects for a first guitar type (e.g., steel-string guitar) and adjusts the audio effects volume/intensity knob 660 (e.g., 20% of Preset 1) to work, for example, for a guitar solo sound using a distortion type audio effect sound. Next, the user applies the same audio effects chain to use for a second type of guitar (e.g., nylon-string guitar) and adjusts, as needed, the audio effects volume/intensity knob 660 (e.g., 75% of Preset 1) until a desired tone is achieved. It is the presence of the audio effects volume/intensity knob 660 on the app (and the ability to adjust its level) being within each preset that enables production of the desired audio effects level/intensity that in turn enable the audio effects preset chain to work on multiple guitar types. The preset volume/intensity knob 660 can be adjusted in the iCable app or, in other embodiments, in the iClip and iPedal.

iCable for Other Instruments

The iCable can be also be used with a microphone and other instruments, not just a guitar. For example, because almost all electronic keyboards use an instrument cable to produce their amplified sound, the iCable can also be used with an electronic (piano) keyboard to enhance the keyboard sound though audio effects such as reverb and delay.

In addition, wind instruments from flute to trumpet to harmonica as well as other instruments, even drums when amplified electronically, can benefit from the portability and dynamic audio effects sonic expansion from the invention and use of the iCable.

The invention claimed is:

1. A detachable audio adapter comprising:

a male input end of the detachable audio adapter configured for connection to an instrument or a microphone;

a rigid housing including:

an analog-to-digital converter configured to convert an audio signal to a digital signal, the audio signal produced by the instrument or the microphone;

a wireless receiver configured to receive one or more audio effects from an app on a computing device;

a microcontroller configured to store the one or more audio effects in a memory; and a digital signal processor configured to apply at least one of the one or more audio effects to the digital signal to produce a processed signal;

a digital-to-analog converter configured to convert the processed signal to an analog output signal; and a female output end of the detachable audio adapter configured for connection to an analog audio cable, wherein the analog-to-digital converter, the wireless receiver, the microcontroller, the digital signal processor, the digital-to-analog converter, and the female output end of the detachable audio adapter are included in the rigid housing instead of the audio cable.

2. The detachable audio adapter of claim 1, further comprising an external controller configured to select at least one of the one or more audio effects.

3. The detachable audio adapter of claim 2, wherein the external controller is familiarly located for a musician.

4. The detachable audio adapter of claim 1, wherein the wireless receiver is further configured to receive one or more parameters, the one or more parameters for adjusting at least one of the one or more audio effects.

5. The detachable audio adapter of claim 1, wherein the analog audio cable is an instrument cable or a microphone cable.

6. The detachable audio adapter of claim 1, further comprising one or more preset buttons.

7. A method for processing audio within a detachable audio adapter, the detachable audio adapter having a male input end and a female output end, the male input end configured for connection to one of an instrument or a microphone, the female output end configured for connection to an analog audio cable, the method comprising:

receiving, at the male input end, an audio signal from one of the instrument or the microphone;

converting, using an analog-to-digital converter within the detachable audio adapter, the audio signal to a digital signal;

receiving, using a wireless receiver within the detachable audio adapter, one or more audio effects from an app on a computing device;

storing, using a microcontroller within the detachable audio adapter, the one or more audio effects in a memory;

applying, using a digital signal processor within the detachable audio adapter, at least one of the one or more audio effects to the digital signal to produce a processed signal;

converting, using a digital-to-analog converter within the detachable audio adapter, the processed signal to an analog output signal; and receiving, at the female output end, the analog output signal, the analog output signal to be output to the analog audio cable, wherein the analog-to-digital converter, the wireless receiver, the microcontroller, the digital signal processor, the digital-to-analog converter, and the female end are included in a rigid housing instead of the analog audio cable.

8. The method of claim 7, wherein the analog output signal is output to the output device, and the output device is one of: an amplifier; a powered speaker; a PA system; a music mixer; and a recording device.

9. The method of claim 7, further comprising receiving, using the wireless receiver, a selection of at least one of the one or more audio effects from an external controller.

10. The method of claim 9, wherein the external controller is familiarly located for a musician.

11. The method of claim 7, further comprising receiving, using the wireless receiver, one or more parameters, the one or more parameters for adjusting at least one of the one or more audio effects.

12. The method of claim 7, wherein the analog audio cable is an instrument or microphone cable.

13. The method of claim 7, further comprising receiving, from a preset button on the detachable audio adapter, a preset selection.

14. A detachable audio adapter comprising:

a rigid housing, comprising:

a female input end of the detachable audio adapter configured for connection to an analog audio cable;

an analog-to-digital converter configured to convert an audio signal to a digital signal, the audio signal produced by an instrument or a microphone;

a wireless receiver configured to receive one or more audio effects from an app on a computing device;

a microcontroller configured to store the one or more audio effects in a memory; and a digital signal processor configured to apply at least one of the one or more audio effects to a digital signal to produce a processed signal, the digital signal converted from an analog signal, the analog signal produced by one of an instrument or a microphone; and a digital-to-analog converter configured to convert the processed signal to an analog output signal; and a male output end of the detachable audio adapter configured for connection to an output device, wherein the female input end of the detachable audio adapter, the analog-to-digital converter, the wireless receiver, the microcontroller, the digital signal processor, and the digital-to-analog converter are included in the rigid housing instead of the analog audio cable.

15. The detachable audio adapter of claim 14, wherein the analog output signal is output to the output device, and the output device is one of: an amplifier; a powered speaker; a PA system; a music mixer; and a recording device.

16. The detachable audio adapter of claim 14, further comprising an external controller configured to select at least one of the one or more audio effects.

17. The detachable audio adapter of claim 16, wherein the external controller is familiarly located for a musician.

18. The detachable audio adapter of claim 14, wherein the wireless receiver is further configured to receive one or more parameters, the one or more parameters for adjusting at least one of the one or more audio effects.

19. The detachable audio adapter of claim 14, wherein the analog audio cable is an instrument or microphone cable.

20. The detachable audio adapter of claim 14, further comprising one or more preset buttons.

21. A detachable audio adapter comprising:

a rigid housing including:

a female input end of the detachable audio adapter configured for connection to an analog audio cable;

an analog-to-digital converter configured to convert an audio signal to a digital signal, the audio signal produced by an instrument or a microphone;

a wireless receiver configured to receive one or more audio effects from an app on a computing device;

a microcontroller configured to store the one or more audio effects in a memory; and a digital signal processor configured to apply at least one of the one or more audio effects to the digital signal to produce a processed signal; and a digital-to-analog converter configured to convert the processed signal to an analog output signal; and a male output end of the detachable audio adapter configured for connection to an output device.

22. The detachable audio adapter of claim 21, wherein the analog output signal is output to the output device, and the output device is one of: an amplifier; a powered speaker; a PA system; a music mixer; and a recording device.

23. The detachable audio adapter of claim 21, further comprising an external controller configured to select at least one of the one or more audio effects.

24. The detachable audio adapter of claim 23, wherein the external controller is familiarly located for a musician.

25. The detachable audio adapter of claim 21, wherein the wireless receiver is further configured to receive one or more parameters, the one or more parameters for adjusting at least one of the one or more audio effects.

26. The detachable audio adapter of claim 21, wherein the analog audio cable is an instrument cable or a microphone cable.

27. The detachable audio adapter of claim 21, further comprising one or more preset buttons.

* * * * *